US010279460B2

(12) United States Patent
Li

(10) Patent No.: US 10,279,460 B2
(45) Date of Patent: May 7, 2019

(54) NAIL FEEDING DEVICE FOR A MAGAZINE OF COIL NAILER

(71) Applicant: Xiaorong Li, Zhejiang (CN)

(72) Inventor: Xiaorong Li, Zhejiang (CN)

(73) Assignee: Zhejiang Rongpeng Air Tools Co., Ltd., Taizhou, Zhejiang (CN)

( * ) Notice: Subject to any disclaimer, the term of this patent is extended or adjusted under 35 U.S.C. 154(b) by 383 days.

(21) Appl. No.: 15/201,613

(22) Filed: Jul. 4, 2016

(65) Prior Publication Data

US 2018/0001452 A1 Jan. 4, 2018

(51) Int. Cl.
*B25C 1/00* (2006.01)
*B25C 1/04* (2006.01)

(52) U.S. Cl.
CPC ..... *B25C 1/003* (2013.01); *B25C 1/04* (2013.01)

(58) Field of Classification Search
CPC ..... B25C 1/003; B25C 1/04; B25C 1/044; B25C 1/005; B25C 1/06; B25C 1/184; B25C 1/001; B25C 5/1686; B25C 5/1658; B25C 5/16; B25C 5/1682; B25C 7/00; B21J 15/12; B21J 15/025; B21J 15/28; Y10S 209/915; Y10S 209/919; Y10S 209/916; B23P 19/008; B25B 23/06; B27F 7/13; B27M 3/0073; B23B 13/022
USPC ..... 227/119–139
See application file for complete search history.

(56) References Cited

U.S. PATENT DOCUMENTS 3,656,520 A * 4/1972 Caffa ..... B25B 23/045 227/136
4,600,135 A * 7/1986 Mukoyama ..... B25C 1/003 227/120
6,957,757 B1 * 10/2005 Huang ..... B25C 1/003 206/338
7,234,623 B2 * 6/2007 Li ..... B25C 1/003 227/120
2010/0001034 A1 * 1/2010 Huang ..... B25C 1/04 227/120

* cited by examiner

*Primary Examiner* — Hemant Desai
*Assistant Examiner* — Amelia Jae-Ippel Vorce

(57) ABSTRACT

A nail feeding device for a magazine of coil nailer, comprising a housing, a handle, a nailer head, a magazine assembly; the magazine assembly comprising a nail receiving chamber, one end of the nail receiving chamber being connected with the handle, and the opposite end thereof being connected with the nailer head; the nail receiving chamber comprising a cover, a nail feeding pallet disposed therein, a post disposed at a center of the nail feeding pallet, and a sliding groove; the sliding groove having an opening; the nail feeding pallet correspondingly comprising an pallet adjuster; wherein the nail feeding pallet can be moved outwardly from the nail receiving chamber, thereby having more space in the magazine, and keeping the handle and the magazine from disturbing the loading process. The coil nails loading process has been improved to a great extent.

3 Claims, 3 Drawing Sheets

NAIL FEEDING DEVICE FOR A MAGAZINE OF COIL NAILER

CROSS-REFERENCE TO RELATED APPLICATION

The application claims priority from China Patent Application No. 201620219148.9, filed Mar. 3, 2016, the contents of which are hereby incorporated by reference in their entirety for all purposes.

FIELD OF THE INVENTION

The present invention relates to a nail feeding device for a magazine of coil nailer.

BACKGROUND OF THE INVENTION

A coil nailer is a pneumatic tool used for fixing one thing to another with nails and mainly comprises of a nailer body and a magazine; the magazine normally comprises a pallet disposed therein and a post disposed at a center of the pallet; the coil nails are placed on the pallet and centered around the post, so that the coil nailer can ensure continuation of normal operation. However, most pallets are firmly fastened to the magazine that cannot be moved, and the post and the pallet are an integral structure that also cannot be moved. The post is usually fixed at the center of the magazine so that a nail feeding space disposed inside the magazine cannot be changeable; therefore, the traditional coil nailers are easy to block the magazine from feeding the coil nails; the conventional solution is to increase the distance between the post and the handle, but this will cause the overall structure larger and increase the material and production cost.

SUMMARY OF INVENTION

The present invention is to solve the above-mentioned problems and provide a nail feeding device for the magazine of the coil nailer that can make an outward movement from the magazine, thereby increasing more space when loading the coil nails and decreasing the material and production cost.

The technical scheme of the present invention is to provide a nail feeding device for a magazine of coil nailer, comprising a housing, a handle disposed below the housing, a nailer head disposed at a front end of the housing a magazine assembly being compatible and combined with the nailer head; the magazine assembly comprising a nail receiving chamber, one end of the nail receiving chamber being connected with the handle, and the opposite end thereof being connected with the nailer head; the nail receiving chamber comprising a cover disposed at one side thereof and connected therewith by a hinge, a nail feeding pallet disposed therein, a post disposed at a center of the nail feeding pallet, and a sliding groove disposed at a bottom end thereof; the sliding groove having an opening arranged therebelow; wherein the sliding groove is larger in diameter than the opening; the nail feeding pallet correspondingly comprises a pallet adjuster disposed therebelow; the pallet adjuster comprises a stop part, a sliding part being compatible with the opening; the sliding part is formed with positioning devices disposed at both sides thereof; the positioning devices comprise mounting holes, springs installed in the mounting holes, and steel balls disposed at one end of the springs; the opening comprises concave parts at an inner wall thereof and corresponding to the steel balls.

More particularly, wherein the nail receiving chamber comprises a positioning groove disposed at a lower surface thereof and corresponding with the opening, the positioning groove being larger in diameter than the opening; the positioning groove comprises a cover plate being compatible and connected with the sliding part through a screw.

More particularly, wherein the concave parts are configured as a curve shape in a cross section view.

Compared to the prior art, the advantages of the present invention is that the sliding part and the nail feeding pallet can be moved freely in the opening by pushing the cover plate, when loading the coil nails, the nail feeding pallet can be moved outwardly from the nail receiving chamber, thereby having more space in the magazine, and keeping the handle and the magazine from disturbing the loading process. The coil nails loading process has been improved to a great extent.

DETAILED DESCRIPTION OF THE PREFERRED EMBODIMENTS

The following embodiments with reference to the drawings of the present invention are further described.

Figure 1:
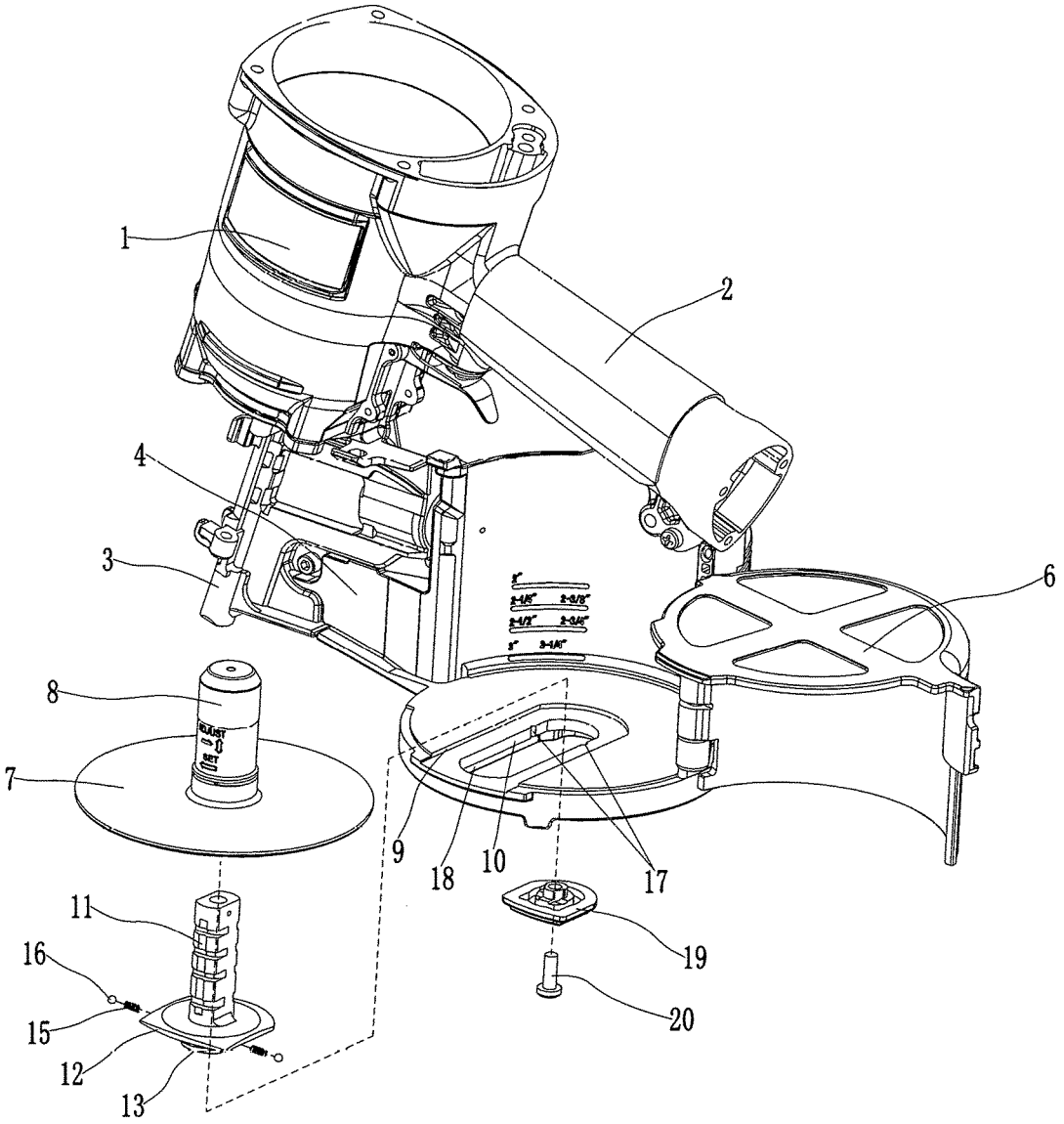
FIG. 1 is a schematic view of a nail feeding device for a magazine of coil nailer of the present invention.
Figure 2:
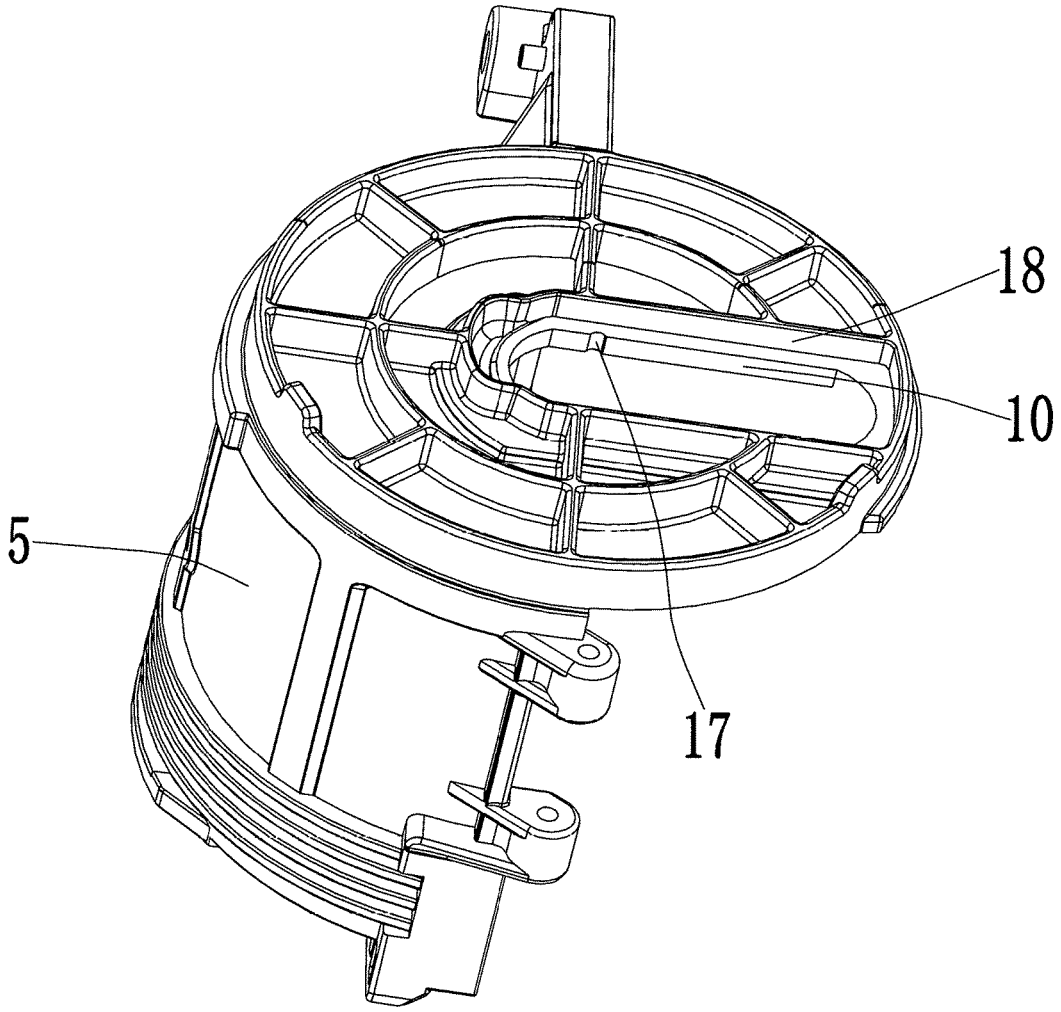
FIG. 2 is a schematic view of a nail receiving chamber.
Figure 3:
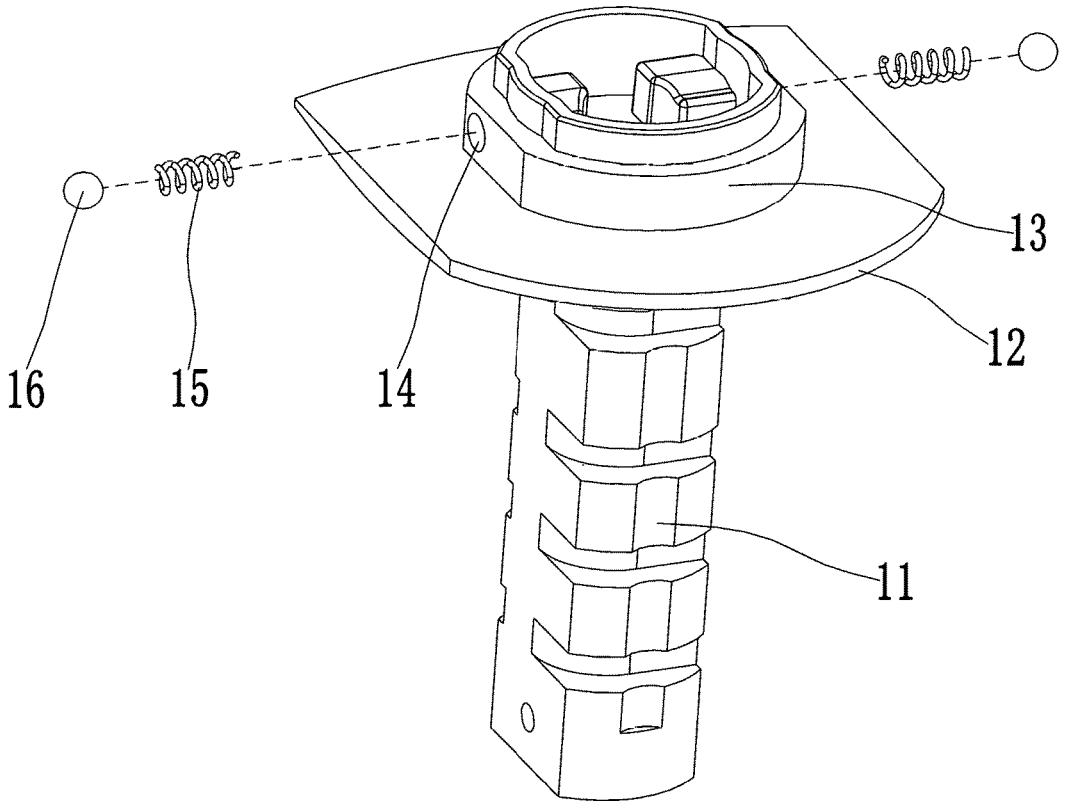
FIG. 3 is a schematic view of pallet adjuster.

Referring to FIGS. 1-3, the present invention provides a nail feeding device for a magazine of coil nailer, comprising a housing (1), a handle (2) disposed below the housing (1), a nailer head (3) disposed at a front end of the housing (1), a magazine assembly (4) being compatible and combined with the nailer head (3); the magazine assembly (4) comprising a nail receiving chamber (5), one end of the nail receiving chamber (5) being connected with the handle (2), and the opposite end thereof being connected with the nailer head (3); the nail receiving chamber (5) comprising a cover (6) disposed at one side thereof and connected therewith by a hinge, a nail feeding pallet (7) disposed therein, a post (8) disposed at a center of the nail feeding pallet (7), and a sliding groove (9) disposed at a bottom end thereof; the sliding groove (9) having an opening (10) arranged therebelow; wherein the sliding groove (9) is larger in diameter than the opening (10; the nail feeding pallet (7) correspondingly comprises a pallet adjuster (11) disposed therebelow; the pallet adjuster (11) comprises a stop part (12), a sliding part (13) being compatible with the opening (10); the sliding part (13) is formed with positioning devices disposed at both sides thereof; the positioning devices comprise mounting holes (14), springs (15) installed in the mounting holes (14), and steel balls (16) disposed at one end of the springs (15); the opening (10) comprises concave parts (17) at an inner wall thereof and corresponding to the steel balls (16).

The nail receiving chamber (5) comprises a positioning groove (18) disposed at a lower surface thereof and corresponding with the opening (10), the positioning groove (18) being larger in diameter than the opening (10); the positioning groove (18) comprises a cover plate (19) being compatible and connected with the sliding part (13) through a screw (20).

Wherein the concave parts (17) are configured as a curve shape in a cross section view.

A method of using the nail feeding device for a magazine of coil nailer is as follows:

Firstly, when loading the coil nails into the magazine of the coil nailer, the cover (6) needs to be opened so that the nail feeding pallet (7) can be seen and contacted directly; if the nail feeding pallet (7) needs to be moved, the cover plate (19) needs to be pushed outwardly and moved away from the nail receiving chamber (5) by an external force, and the pallet adjuster (11) will be moved along therewith; when the pallet adjuster (11) is moving, the nail feeding pallet (7) will be moved simultaneously along therewith; in this case, steel balls (16) will be moved out of the concave parts (17) under the external force, and the springs (15) are squeezed during the movement of the steel balls (16).

Secondly, the sliding part (13) can be moved outwardly along a track of the opening (10), and bring along the nail feeding pallet (7); when the sliding part (13) is moving outwardly to an end of the opening (10) where the inner wall stops the movement of the sliding part (13) and can load the coil nails into the nail receiving chamber (5), the loaded coil nails are centered around the post (8) of the nail feeding pallet (7), thereby having sufficient space to load the cod nails and keeping the handle (2) and the magazine from disturbing the loading process. The coil nails loading process has been improved to a great extent.

When the nail loading is finished, it needs to push the cover plate (19) inwardly to bring along the nail feeding pallet (7) moving toward the nail receiving chamber (5), the sliding part (13) is also moving along with the nail feeding pallet (7); when the sliding part (13) is moving along the track of the opening (10) to the concave parts (17), the steel balls (16) will be pushed out of the mounting holes (1) by force of the springs (14) and fixed in the concave parts (17); in this case, the nail feeding pallet (7) is positioned and one end of the coil nail is arranged inside the nailer head (3); at last, it only needs to close the cover (6) and can start using the coil nailer.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A nail feeding device for a magazine of a coil nailer, comprising a housing, a handle disposed below the housing, a nailer head disposed at a front end of the housing, a magazine assembly being compatible and combined with the nailer head; the magazine assembly comprising a nail receiving chamber, one end of the nail receiving chamber being connected with the handle, and the opposite end thereof being connected with the nailer head; the nail receiving chamber comprising a cover disposed at one side thereof and connected therewith by a hinge, a nail feeding pallet disposed therein, a post disposed at a center of the nail feeding pallet, and a sliding groove disposed at a bottom end thereof; the sliding groove having an opening arranged therebelow; wherein the sliding groove is larger in diameter than the opening; the nail feeding pallet correspondingly comprises a pallet adjuster disposed therebelow; the pallet adjuster comprises a stop part, a sliding part being compatible with the opening, and positioning devices being disposed on both sides of the sliding part; the positioning devices comprise mounting holes, springs installed in the mounting holes, and steel balls disposed at one end of the springs; the opening comprises concave parts at an inner wall thereof and corresponding to the steel balls.

2. The nail feeding device according to claim 1, wherein the nail receiving chamber comprises a positioning groove disposed at a lower surface thereof and corresponding with the opening, the positioning groove being larger in diameter than the opening; the positioning groove comprises a cover plate being compatible and connected with the sliding part through a screw.

3. The nail feeding device according to claim 1, wherein the concave parts are configured as a curve shape in a cross section view.

* * * * *